US006923002B2

(12) United States Patent
Crawley et al.

(10) Patent No.: US 6,923,002 B2
(45) Date of Patent: Aug. 2, 2005

(54) COMBUSTION LINER CAP ASSEMBLY FOR COMBUSTION DYNAMICS REDUCTION

(75) Inventors: Bradley Donald Crawley, Simpsonville, SC (US); James Fossum, Greer, SC (US)

(73) Assignee: General Electric Company, Schenectady, NY (US)

( * ) Notice: Subject to any disclaimer, the term of this patent is extended or adjusted under 35 U.S.C. 154(b) by 83 days.

(21) Appl. No.: 10/650,194

(22) Filed: Aug. 28, 2003

(65) Prior Publication Data

US 2005/0044855 A1 Mar. 3, 2005

(51) Int. Cl.[7] ..... F23R 3/32

(52) U.S. Cl. ..... 60/772; 60/39.37; 60/737; 60/725; 29/890.02

(58) Field of Search ..... 60/772, 800, 39.37, 60/737, 738, 725; 29/890.02

(56) References Cited

U.S. PATENT DOCUMENTS

| | | | | |
|---|---|---|---|---|
| 3,075,352 A | | 1/1963 | Shutts | |
| 4,100,733 A | | 7/1978 | Striebel et al. | |
| 4,199,936 A | | 4/1980 | Cowan et al. | |
| 5,274,991 A | | 1/1994 | Fitts | |
| 5,329,772 A | | 7/1994 | Fitts et al. | |
| 5,357,745 A | * | 10/1994 | Probert | 60/39.37 |
| 5,423,368 A | | 6/1995 | Fitts et al. | |
| 6,427,446 B1 | * | 8/2002 | Kraft et al. | 60/737 |
| 2002/0148228 A1 | * | 10/2002 | Kraft et al. | 60/772 |

FOREIGN PATENT DOCUMENTS

| | | |
|---|---|---|
| EP | 0 564 185 | 10/1993 |
| EP | 0 841 520 | 5/1998 |
| EP | 1 288 577 | 3/2003 |

* cited by examiner

*Primary Examiner*—Ehud Gartenberg
(74) *Attorney, Agent, or Firm*—Nixon & Vanderhye P.C.

(57) ABSTRACT

A combustion liner cap assembly includes a cylindrical outer sleeve supporting internal structure therein and a plurality of fuel nozzle openings formed through the internal structure. A first set of circumferentially spaced cooling holes is formed through the cylindrical outer sleeve, and a second set of circumferentially spaced cooling holes is formed through the cylindrical outer sleeve. The second set of cooling holes is axially spaced from the first set of cooling holes. The resulting construction serves to decrease combustion dynamics in a simplified manner that is retrofittable to current designs and reversible without impacting the original configuration. The reduction in combustion dynamics improves hardware life, which leads to reduced repair and replacement costs.

11 Claims, 2 Drawing Sheets

COMBUSTION LINER CAP ASSEMBLY FOR COMBUSTION DYNAMICS REDUCTION

BACKGROUND OF THE INVENTION

The invention relates to gas and liquid fueled turbines and, more particularly, to combustors and a combustion liner cap assembly in industrial gas turbines used in power generation plants.

A combustor typically includes a generally cylindrical casing having a longitudinal axis, the combustor casing having fore and aft sections secured to each other, and the combustion casing as a whole secured to the turbine casing. Each combustor also includes an internal flow sleeve and a combustion liner substantially concentrically arranged within the flow sleeve. Both the flow sleeve and combustion liner extend between a double walled transition duct at their forward or downstream ends with a sleeve cap assembly (located within a rearward or upstream portion of the combustor) at their rearward ends. The flow sleeve is attached directly to the combustor casing, while the liner receives the liner cap assembly which, in turn, is fixed to the combustor casing. The outer wall of the transition duct and at least a portion of the flow sleeve are provided with air supply holes over a substantial portion of their respective surfaces, thereby permitting compressor air to enter the radial space between the combustion liner and the flow sleeve, and to be reverse flowed to the rearward or upstream portion of the combustor where the air flow direction is again reversed to flow into the rearward portion of the combustor and towards the combustion zone.

A plurality (e.g., five) of diffusion/premix fuel nozzles are arranged in a circular array about the longitudinal axis of the combustor casing. These nozzles are mounted in a combustor end cover assembly which closes off the rearward end of the combustor. Inside the combustor, the fuel nozzles extend into a combustion liner cap assembly and, specifically, into corresponding ones of the premix tubes. The forward or discharge end of each nozzle terminates within a corresponding premix tube, in relatively close proximity to the downstream end of the premix tube which opens to the burning zone in the combustion liner. An air swirler is located radially between each nozzle and its associated premix tube at the rearward or upstream end of the premix tube, to swirl the compressor air entering into the respective premix tube for mixing with premix fuel.

High combustion dynamics in a gas turbine combustor can cause disadvantages such as preventing operation of the combustion system at optimum (lowest) emissions levels. High dynamics can also damage hardware to a point that could result in a forced outage of the gas turbine. Hardware damage that does occur but does not cause a forced outage increases repair costs. Several corrective actions have been considered for reducing combustion dynamics in a gas turbine combustor. Tuning through fuel split changes, control changes and nozzle resizing have been tried with varying degrees of success. Often, a combination of these and other efforts is made to provide the best overall solution. Tuning and control setting changes are considered normal approaches to mitigating combustion dynamics as they are relatively simple changes to make when compared to other more costly and intrusive approaches such as changing hardware. Limitations do exist, however, as it is not only combustion dynamics that must be considered when tuning fuel splits or adjusting control settings. The effects on emissions ($NO_x$, CO, and UHC), output, heat rate, exhaust temperature, fuel mode transfers, and turndown should all be considered when using these methods to mitigate dynamics and always involves a trade-off.

Nozzle resize is also an option sometimes used to deal with high dynamics but is typically reserved for use when the fuel composition has changed significantly from the design point. Also costly and time-consuming, this option has the disadvantage of having only a certain range of application based on the design pressure ratio range of the nozzle. A further change in fuel composition could once again require a different nozzle if the dynamics could not be tuned.

The design space is typically a last resort in dynamics mitigation at this stage due to the high cost normally associated with the development of a new piece of hardware. The goal is to lower dynamics without impacting the emissions, output, heat rate, exhaust temperature, mode transfer capability, and turndown that are often affected by the normal dynamics mitigation methods. For the most part, a more design oriented approach using small changes such as the cap modification decouples those parameters from the objective of reducing dynamics.

BRIEF SUMMARY OF THE INVENTION

In an exemplary embodiment of the invention, a combustion liner cap assembly includes a cylindrical outer sleeve supporting internal structure therein, and a plurality of fuel nozzle openings formed through the internal structure. A first set of circumferentially spaced cooling holes is formed through the cylindrical outer sleeve, and a second set of circumferentially spaced cooling holes is formed through the cylindrical outer sleeve. The second set of cooling holes is axially spaced from the first set of cooling holes.

In another exemplary embodiment of the invention, a method of decreasing combustion dynamics in a gas turbine includes the steps of providing the combustion liner cap assembly, and forming a second set of circumferentially spaced cooling holes through the cylindrical outer sleeve, wherein the second set of cooling holes is axially spaced from the first set of cooling holes.

In still another exemplary embodiment of the invention, a method of constructing a combustion liner cap assembly includes the steps of providing a cylindrical outer sleeve supporting internal structure therein; forming a plurality of fuel nozzle openings through the internal structure; forming a first set of circumferentially spaced cooling holes through the cylindrical outer sleeve; and forming a second set of circumferentially spaced cooling holes through the cylindrical outer sleeve, wherein the second set of cooling holes is axially spaced from the first set of cooling holes.

DETAILED DESCRIPTION OF THE INVENTION

Figure 1:
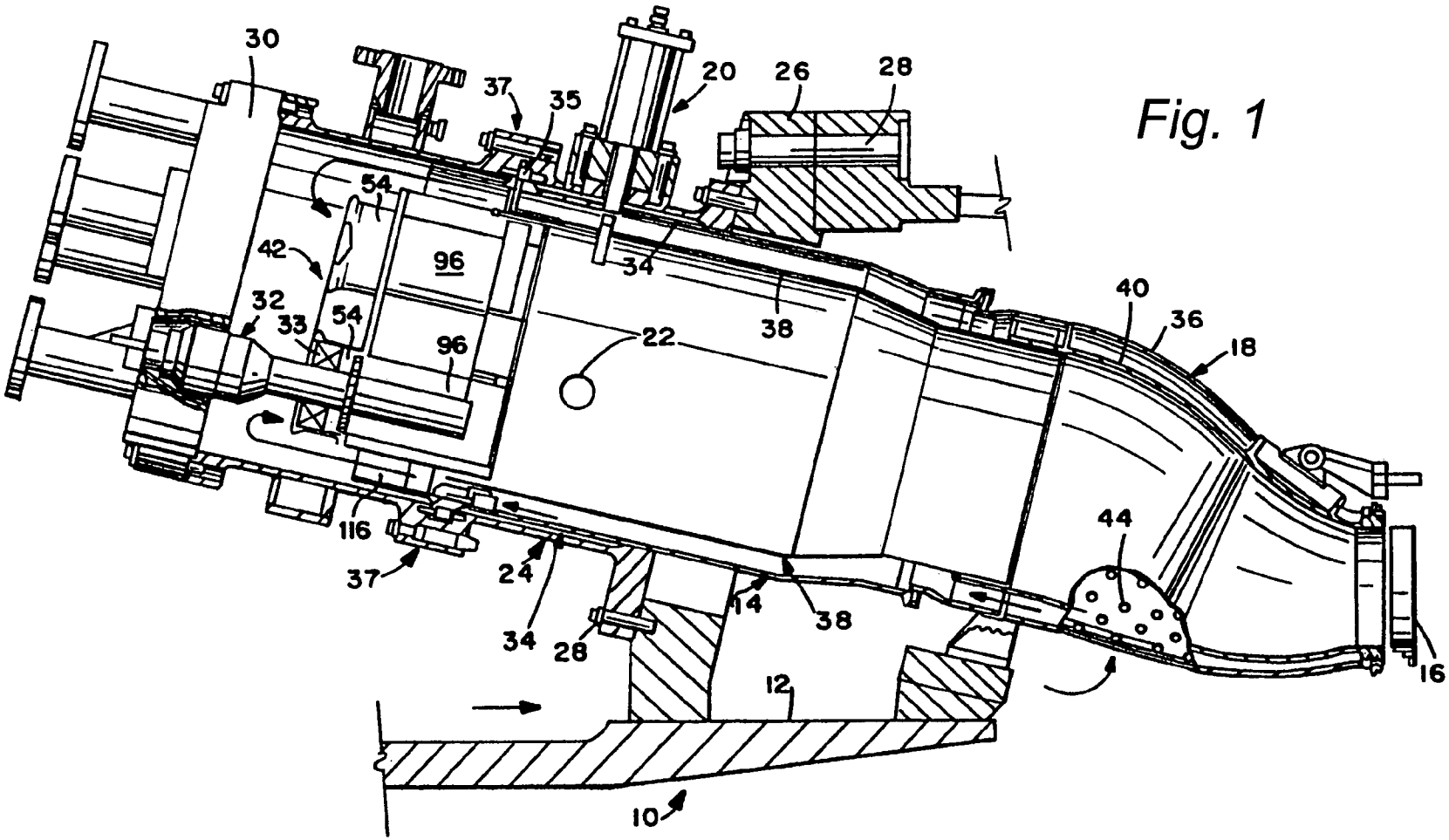
FIG. 1 is a partial cross-section of a gas turbine combustor.

With reference to FIG. 1, the gas turbine 10 includes a compressor 12 (partially shown), a plurality of combustors 14 (one shown), and a turbine represented here by a single blade 16. Although not specifically shown, the turbine is drivingly connected to the compressor 12 along a common axis. The compressor 12 pressurizes inlet air which is then reverse flowed to the combustor 14 where it is used to cool the combustor and to provide air to the combustion process.

As noted above, the gas turbine includes a plurality of combustors 14 located about the periphery of the gas turbine. A double-walled transition duct 18 connects the outlet end of each combustor with the inlet end of the turbine to deliver the hot products of combustion to the turbine.

Ignition is achieved in the various combustors 14 by means of spark plug 20 in conjunction with cross fire tubes 22 (one shown) in the usual manner.

Each combustor 14 includes a substantially cylindrical combustion casing 24 which is secured at an open forward end to the turbine casing 26 by means of bolts 28. The rearward end of the combustion casing is closed by an end cover assembly 30 which may include conventional supply tubes, manifolds and associated valves, etc. for feeding gas, liquid fuel and air (and water if desired) to the combustor. The end cover assembly 30 receives a plurality (for example, five) fuel nozzle assemblies 32 (only one shown with associated swirler 33 for purposes of convenience and clarity) arranged in a circular array about a longitudinal axis of the combustor.

Within the combustor casing 24, there is mounted, in substantially concentric relation thereto, a substantially cylindrical flow sleeve 34 which connects at its forward end to the outer wall 36 of the double walled transition duct 18. The flow sleeve 34 is connected at its rearward end by means of a radial flange 35 to the combustor casing 24 at a butt joint 37 where fore and aft sections of the combustor casing 24 are joined.

Within the flow sleeve 34, there is a concentrically arranged combustion liner 38 which is connected at its forward end with the inner wall 40 of the transition duct 18. The rearward end of the combustion liner is supported by a combustion liner cap assembly 42 as described further below, and which, in turn, is secured to the combustor casing at the same butt joint 37. It will be appreciated that the outer wall 36 of the transition duct 18, as well as that portion of flow sleeve 34 extending forward of the location where the combustion casing 24 is bolted to the turbine casing (by bolts 28) are formed with an array of apertures 44 over their respective peripheral surfaces to permit air to reverse flow from the compressor 12 through the apertures 44 into the annular (radial) space between the flow sleeve 34 and the liner 36 toward the upstream or rearward end of the combustor (as indicated by the flow arrows shown in FIG. 1).

Figure 2:
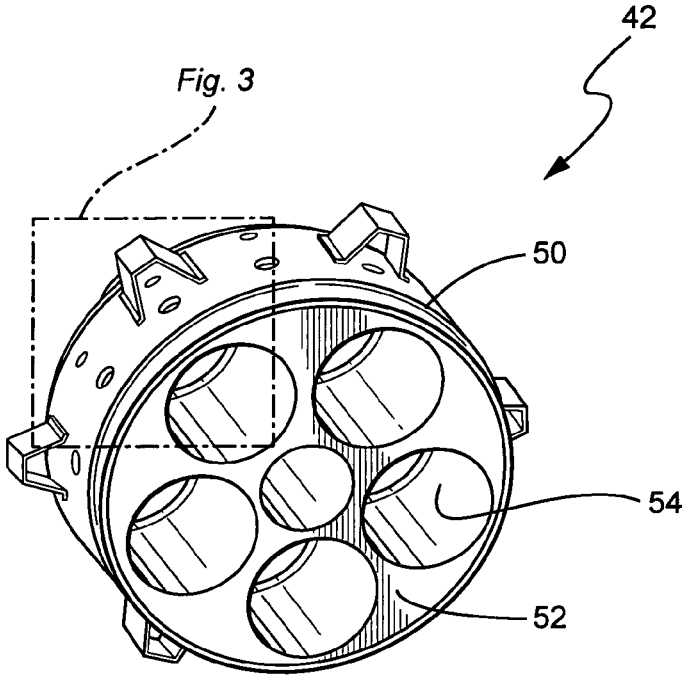
FIG. 2 is a perspective view of a combustion liner cap assembly.

FIG. 2 is a perspective view of the combustion liner cap assembly 42. The details of the assembly 42 are generally known and do not specifically form part of the present invention. As shown, the combustion liner cap assembly 42 includes a generally cylindrical outer sleeve 50 supporting known internal structure 52 therein. A plurality of fuel nozzle openings 54 are formed through the internal structure as is conventional.

Figure 3:
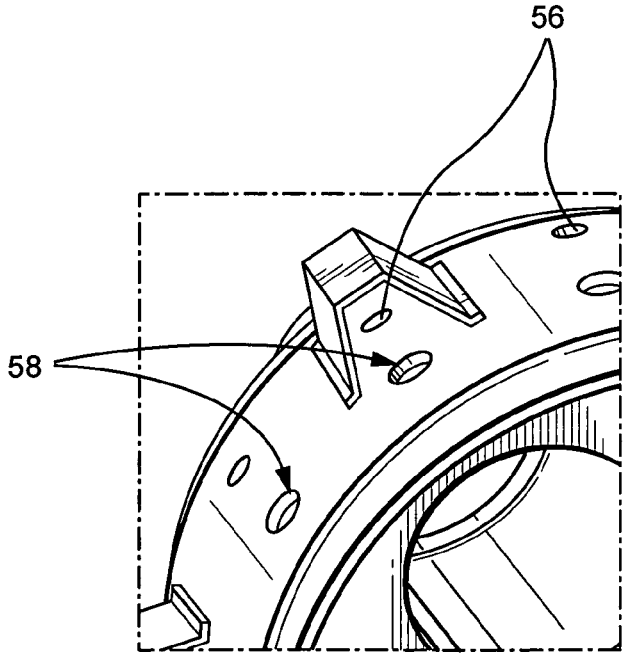
FIG. 3 is a close-up view showing the additional cooling holes in the liner cap outer body sleeve.

With reference to FIG. 3, a first set of circumferentially spaced cooling holes 56 is formed through the cylindrical outer sleeve 50. These conventional holes permit compressor air to flow into the liner cap assembly. In order to increase air flow through the cap effusion plate, a second set of circumferentially spaced cooling holes 58 is formed through the cylindrical outer sleeve 50, where the cooling holes are preferably axially spaced from the first set of cooling holes 56. Preferably, eight cooling holes 58 are included in the second set and have a diameter of about 0.75 inches. The second set of cooling holes 58 enables increased air flow for better stabilizing the combustion flame. In an exemplary application, the modification reduces one of the three characteristic tones of the DLN2+ combustion system which allows easier optimization of the remaining two tones during the integrated tuning process. That is, the DLN2+ combustion system has three characteristic combustion dynamics frequencies. This modification reduces one of those tones. Normal tuning methods of fuel split and purge adjustments can then be used to reduce the remaining two tones. The reduction in combustion dynamics improves or allows for easier tuning of the units and leads to reduced repair and replacement costs since elevated dynamics levels can decrease hardware life and possibly lead to hardware failure. The construction results in a simplified resolution to problems of existing configurations and is retrofittable to current designs.

The construction can also be returned to the original configuration by covering the second set of cooling holes 58 if deemed necessary without affecting the air flow to the original holes 56. That is, the holes added by this design improvement could be repaired by welding a metal disc or the like over the hole to block the airflow into the hole. The configuration and functionality of the part is then returned to the original design configuration.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A combustion liner cap assembly comprising:

a cylindrical outer sleeve supporting internal structure therein; and a plurality of fuel nozzle openings formed through said internal structure, wherein a first set of circumferentially spaced cooling holes is formed through said cylindrical outer sleeve, and wherein a second set of circumferentially spaced cooling holes is formed through said cylindrical outer sleeve, said second set of cooling holes being axially spaced from said first set of cooling holes.

2. A combustion liner cap assembly according to claim 1, wherein said second set of cooling holes comprises eight cooling holes formed about a periphery of the cylindrical outer sleeve.

3. A combustion liner cap assembly according to claim 1, wherein said second set of cooling holes each comprises a diameter of about 0.75 inches.

4. A method of decreasing combustion dynamics in a gas turbine, the method comprising:

providing a combustion liner cap assembly including a cylindrical outer sleeve supporting internal structure therein, and a plurality of fuel nozzle openings formed through the internal structure, wherein a first set of circumferentially spaced cooling holes is formed through the cylindrical outer sleeve; and forming a second set of circumferentially spaced cooling holes through the cylindrical outer sleeve, wherein the second set of cooling holes is axially spaced from the first set of cooling holes.

5. A method according to claim 4, wherein the forming step comprises forming the second set of cooling holes with eight cooling holes.

6. A method according to claim 4, wherein the forming step comprises forming the holes with a diameter of about 0.75 inches.

7. A method according to claim 4, wherein the forming step is practiced such that the second set of cooling holes may be rendered ineffective.

8. A method of constructing a combustion liner cap assembly, the method comprising:

providing a cylindrical outer sleeve supporting internal structure therein;

forming a plurality of fuel nozzle openings through the internal structure;

forming a first set of circumferentially spaced cooling holes through the cylindrical outer sleeve; and forming a second set of circumferentially spaced cooling holes through the cylindrical outer sleeve, wherein the second set of cooling holes is axially spaced from the first set of cooling holes.

9. A method according to claim 8, wherein the step of forming the second set of cooling holes comprises forming the second set of cooling holes with eight cooling holes.

10. A method according to claim 8, wherein the step of forming the second set of cooling holes comprises forming the holes with a diameter of about 0.75 inches.

11. A method according to claim 8, wherein the step of forming the second set of cooling holes is practiced such that the second set of cooling holes may be rendered ineffective.

* * * * *